US005525046A

United States Patent [19]

Hartmann

[11] Patent Number: 5,525,046

[45] Date of Patent: Jun. 11, 1996

[54] HIGH PRESSURE CLEANING DEVICE WITH LEAKAGE FLOW ARRANGEMENT

[75] Inventor: Lothar Hartmann, Oerlinghausen, Germany

[73] Assignee: Elektra Beckum AG, Germany

[21] Appl. No.: 379,996

[22] Filed: Jan. 27, 1996

[30] Foreign Application Priority Data

Feb. 10, 1994 [DE] Germany ..... 44 04 149.7
Mar. 2, 1994 [DE] Germany ..... 44 06 869.7

[51] Int. Cl.[6] ..... F04B 49/00

[52] U.S. Cl. ..... 417/300; 239/526; 239/583; 137/513.5; 137/513.7

[58] Field of Search ..... 417/300; 137/513.3, 137/513.5, 513.7; 239/526, 583

[56] References Cited

U.S. PATENT DOCUMENTS

| | | | |
|---|---|---|---|
| 1,438,239 | 12/1922 | Heinrich | 239/526 |
| 1,788,358 | 1/1931 | Goerg | 137/513.7 |
| 2,363,023 | 11/1944 | Stewart | 401/279 |
| 4,030,520 | 6/1977 | Sands | 137/513.7 |
| 4,674,904 | 6/1987 | Buck | 137/513.5 |
| 4,834,293 | 5/1989 | Lichfield | 239/526 |
| 4,880,166 | 11/1989 | Suttner | 239/526 |
| 5,189,877 | 3/1993 | Wells et al. | 137/513.5 |
| 5,299,767 | 4/1994 | Simpson | 239/526 |
| 5,344,075 | 9/1994 | Springer et al. | 239/526 |
| 5,395,052 | 3/1995 | Schneider et al. | 239/526 |
| 5,406,978 | 4/1995 | Smolong | 137/513.5 |

FOREIGN PATENT DOCUMENTS

| | | | |
|---|---|---|---|
| 0408865 | 1/1991 | European Pat. Off. | 239/526 |
| 2919070 | 11/1979 | Germany | 137/513.7 |
| 3209902 | 3/1982 | Germany . | |
| 3837579 | 11/1988 | Germany . | |
| 3933386 | 12/1990 | Germany | 239/526 |
| 9212797 | 9/1992 | Germany . | |
| 9315960 | 10/1993 | Germany . | |

*Primary Examiner* Richard A. Bertsch
*Assistant Examiner* Ted Kim
*Attorney, Agent, or Firm* Sixbey, Friedman, Leedom & Ferguson; David S. Safran

[57] ABSTRACT

A high pressure cleaning device with a housing (1) containing a driving motor and a pump for cleaning fluid, in particular water, and a bypass valve arrangement, with a valve pistol (2) having a cleaning lance (3) or the like connected thereto, and with a high pressure line (4) leading to valve pistol (2) from a high pressure connection (4) on a housing (1). When the valve pistol (2) is closed, the pump continues to run and circulates, via the bypass valve arrangement, a finite, small volume of cleaning fluid. When the valve pistol (2) is in the closed position, a leakage flow passage having a very high flow resistance remains open, so that, even when the valve pistol (2) is in the closed position, a small leakage flow of cleaning fluid constantly drains out, and is replaced by a corresponding amount of fluid which flows in on the intake side of the pump and cools the circulating fluid.

20 Claims, 5 Drawing Sheets

HIGH PRESSURE CLEANING DEVICE WITH LEAKAGE FLOW ARRANGEMENT

BACKGROUND OF THE INVENTION

1. Field of the Invention

The invention relates to a high pressure cleaning device, especially for cleaning with pressurized water, commonly referred to as a high pressure cleaner.

2. Description of Related Art

High pressure cleaning devices of the type in question have been known for a long time (see, e.g., German Patent 38 37 579). In many high pressure cleaning devices, the pump housing is separated from the valve pistol with the cleaning lance, the valve pistol being connected to the housing by a high pressure line several meters long. The housing, then, is stationary during operation, while the operator, with the valve pistol and the connected cleaning lance in hand, can work in an action radius determined by the length of the high pressure line. High pressure cleaning devices are also known that are made in one piece, in which, i.e., the valve pistol is integrated in the housing and the cleaning lance is connected to the housing. Those are so-called manual units, that are intended mostly for a relatively low pressure range up to 90 bar.

In a high pressure cleaning device of the type in question, generally, a bypass valve arrangement is present, also referred to as an unloader. The unloader is used to relieve the valve pistol of pressure when the valve pistol is closed. While working with such a high pressure cleaning device, one would like to leave the driving motor of the pump continue running during work pauses. So that the pump, on its output side, does not then work against the closed valve in the valve pistol, a bypass line back to the intake side of the pump is opened by the bypass valve arrangement, so that the pump circulates a finite, relatively small volume of cleaning fluid, which generally is only a few liters. The bypass valve arrangement known from the above-explained prior art reacts to the flow, and a flow unloader is involved. On the other hand, there are also spring-loaded bypass valve arrangements that are opened against the pressure of a spring whose spring resistance can be adjusted externally.

In large high pressure cleaning devices for high flow rates and/or high pressures, the materials used in the pump and in the connected lines are high-quality, expensive, and also heat resistant. Especially in smaller high pressure cleaning devices with lower flow rates, increasingly plastic parts are used, which is possible when modern plastics are used in view of the pressures occurring. However, when the pump continues to run for a prolonged time with a closed valve pistol, the temperature of the circulating cleaning fluid rises sharply because of the internal friction in the circuit. Thus, the manufacturers of high pressure cleaning devices in which this difficulty can occur specify in their operating instructions that the pump, during work pauses, is not to continue to run longer than a few minutes. Otherwise, damage, especially to the plastic parts of the pump and the lines, is almost a certainty.

The above-explained problem is known and a solution proposed in German Utility Model 93 15 960. For this purpose, a safety plug made of a material that becomes soft at a certain threshold temperature is attached to the pump intake line between the pump and a back-pressure valve which blocks the supply of water to the pump intake line when the pistol is closed. If the temperature of the cleaning fluid circulating in the circuit reaches the threshold temperature, the plug becomes soft and is pressed out of the pump housing. Water flows away abruptly out of the pump intake line, causing the back pressure to drop allowing fresh water to flow into the intake side of the pump after it, so that damage to the pump is avoided. But, the result is that the high pressure cleaning device is henceforth incapable of operating until overheating plug is replaced.

It is known in the art to provide, on a valve pistol for a high pressure cleaning device, a leakage flow passage that guarantees, at low temperatures, i.e., temperatures below the freezing point of water, a small leakage flow via the valve pistol, so that the valve pistol and the high pressure line do not freeze up (published German Patent Application 32 09 902). Such valve pistols are intended for stationary high pressure cleaning devices, as they are used at gas stations and in the commercial arena. For the small-unit arena, to which the present invention is directed, such valve pistols have not been used up to now, since there "frost protection" is not a problem. Structurally, the leakage flow passages in these freeze-preventing valve pistols are generally configured so they can be closed manually, so that the leakage flow can be turned off when temperatures are above the freezing point (between spring and fall each year).

Another valve pistol with a leakage flow passage for protection against freeze-up (German Utility Model 92 12 797) is configured to open the leakage flow passage only at very low pressure at the inlet side of the valve pistol. Such a valve pistol is suitable absolutely only for large, stationary high pressure cleaning-devices that provide a regular turning off of the high pressure cleaning device with the pump, and thus, the occurrence of low pressure (water-supply pressure). When the pump is running, and thus has higher pressure, the valve system of such a valve pistol is necessarily always closed, since otherwise, after opening once, it always remains open. When the pump is running, such a valve pistol allows no leakage flow, even with the use of an unloader.

SUMMARY OF THE INVENTION

The object of the invention is to provide a solution to the above-described overheating problem in a high pressure cleaning device that does not disrupt the operability of the device, i.e., in particular does not make any repairs to the high pressure cleaning device necessary.

The above-outlined object is achieved in a high pressure cleaning device with the features of the invention in which the high pressure cleaning device has a housing and a driving motor and a pump in it for cleaning fluid, in particular water, and a bypass valve arrangement, with a valve pistol and a high pressure line leading from a high pressure connection on the housing to the valve pistol, in which, when the valve pistol is closed, the pump continues to run and circulates a small volume of cleaning fluid via the bypass valve arrangement, with a leakage flow passage that has a very high flow resistance and remains open when the valve pistol is in the closed position, so that, when the valve pistol is closed, a slight leakage flow of cleaning fluid constantly drains out and a corresponding amount of fluid flows on the intake side of the pump, and, when the valve pistol is closed, the leakage flow passage is constantly open, regardless of pressure, and cannot be closed manually.

According to the invention, a concept is realized that guarantees, during operation, a constant admixing of cool fresh water into the otherwise closed circuit of cleaning fluid when the valve pistol is closed. Because of the intended leakage from the pump circuit, especially at the valve pistol when it is in a closed position, it is achieved that a small amount of fresh water can always flow into the pump on the intake side. The size of the leakage flow out of the pump circuit, in particular via the closed valve pistol, must be matched to the generation of heat by the circulation of cleaning fluid in the circuit, so that, in this state, even with long work pauses of a half hour and more, the temperature of the cleaning fluid in the circuit does not exceed an allowable threshold value of, for example, 60 C (330K). Generally, several ccm/sec suffice as a leakage flow. This will preferably flow via the valve pistol; but, basically, it would also be possible to have a corresponding leakage flow by providing a suitable leakage flow passage at another place, also on the pump itself.

Experiments have shown that the basic water consumption with the concept according to the invention, which could be the only counterargument, is minimal and negligible. With a usual high pressure cleaning device with a flow rate of, e.g., 8,000 ccm/min, here a possibly sufficient leakage flow of 100 ccm/min in an hour's work pause while the pump continues to run (already almost an extreme case) can use only as much water as during 45 seconds of work with the high pressure cleaning device.

These and further objects, features and advantages of the present invention will become apparent from the following description when taken in connection with the accompanying drawings which, for purposes of illustration only, show only a single embodiment in accordance with the present invention.

DETAILED DESCRIPTION OF THE PREFERRED EMBODIMENT

Figure 2:
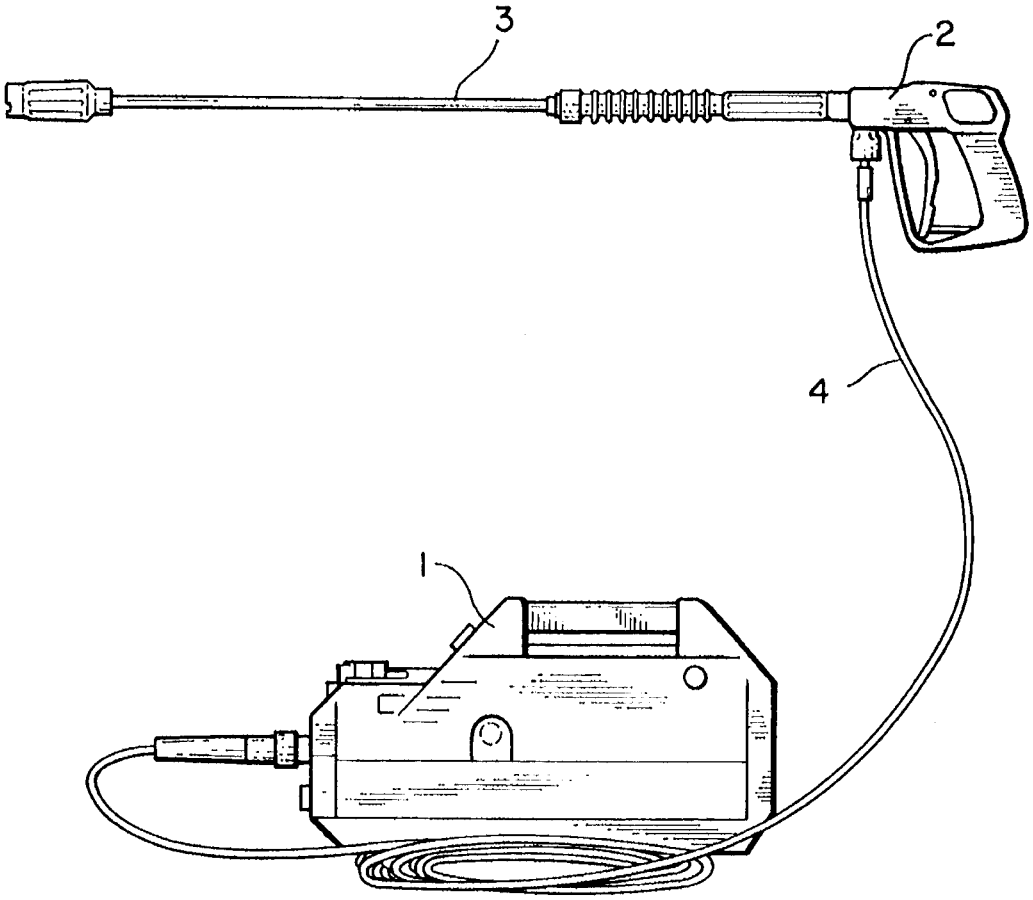
FIG. 2 (PRIOR ART)
FIG. 2 is a diagrammatic view of a cenventional high pressure cleaning device (prior art) which, however, can be easily equipped in its valve pistol with a valve arrangement according to FIG. 1.

The high pressure cleaning device represented in FIG. 2 is typical for common high pressure cleaning devices of the type in question, and works with water, optionally, with an admixture of a cleaning additive. The housing 1 of the high pressure cleaning device usually contains a driving motor, a pump, often an axial piston pump, for the cleaning fluid, especially, i.e., for water, and, among other things, a bypass valve arrangement (unloader). This invention is especially useful in a bypass valve arrangement made as a flow unloader. As reflected by the above background comments, such known cleaning devices are small and more inexpensively constructed in comparison to the large stationary installations as are installed at gas stations and other commercial establishments, the FIG. 2 cleaning device being small enough to be transportable as is apparent from the presence of a handle on the top of the housing 1.

Figure 3:
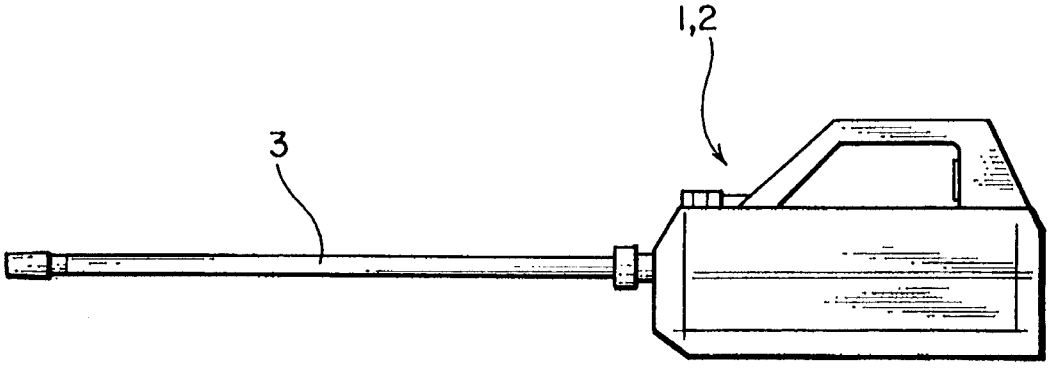
FIG. 3 (PRIOR ART)
FIG. 3 is a modified conventional high pressure cleaning device (prior art) which can be easily equipped with a valve arrangement according to FIG. 1.

In FIG. 2, a valve pistol 2 with a cleaning lance 3 is shown connected to housing 1*a* high pressure line 4, which defines the action radius of an operator. Other devices, e.g., a washing brush, can also be connected to the output side of the valve pistol 2. Basically, it is also conceivable, and known from the prior art, to integrate the valve pistol 2 and the high pressure line 4 into the housing 1, which is then designated as a so-called manual unit; as shown in FIG. 3. The invention can be applied to either of these versions.

Essential is the fact that, in a high pressure cleaning device of the type in question, the pump continues to run during work pauses, when valve pistol 2 is closed, and circulates, via the bypass valve arrangement, a finite, relatively small volume of cleaning fluid. The latter is heated during circulation because of the internal friction in this circuit, which leads to the difficulties explained in the Background portion above, or can lead to these difficulties, when high-quality, heat-resistant material, such as brass, is not used.

As should be apparent from the figures, when valve pistol 2 is in the closed position, a leakage flow passage 5 that has a very high flow resistance remains open and thus, when valve pistol 2 is in the closed position, a small leakage flow of cleaning fluid drains out, in particular by valve pistol 2, and a corresponding amount of fluid flows in on the intake side of the pump.

Figure 1A:
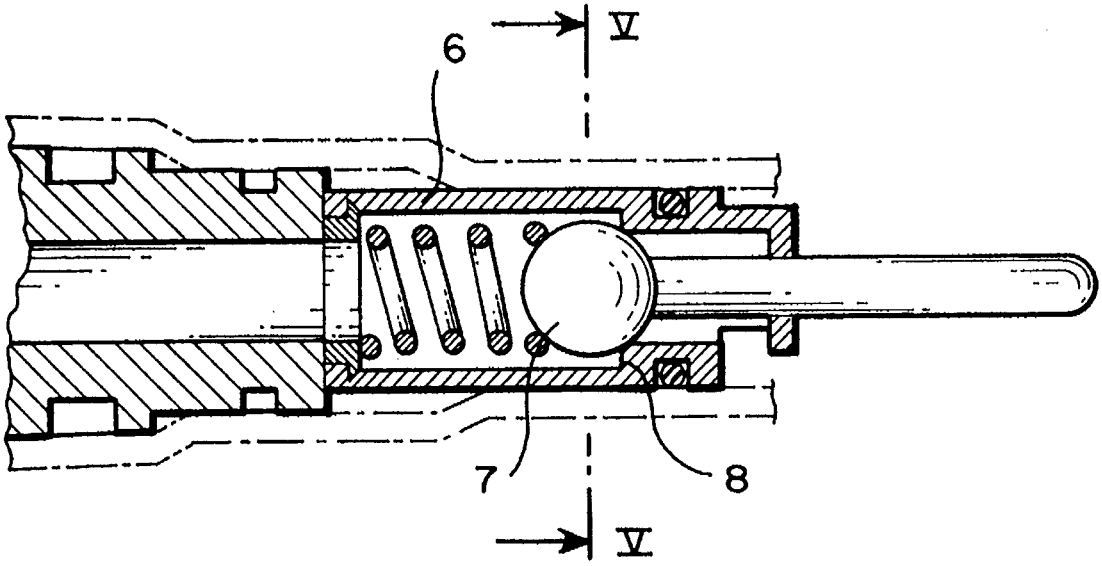
FIG. 1*a* is a first valve arrangement in a valve pistol of a high pressure cleaning device according to the invention.
Figure 4:
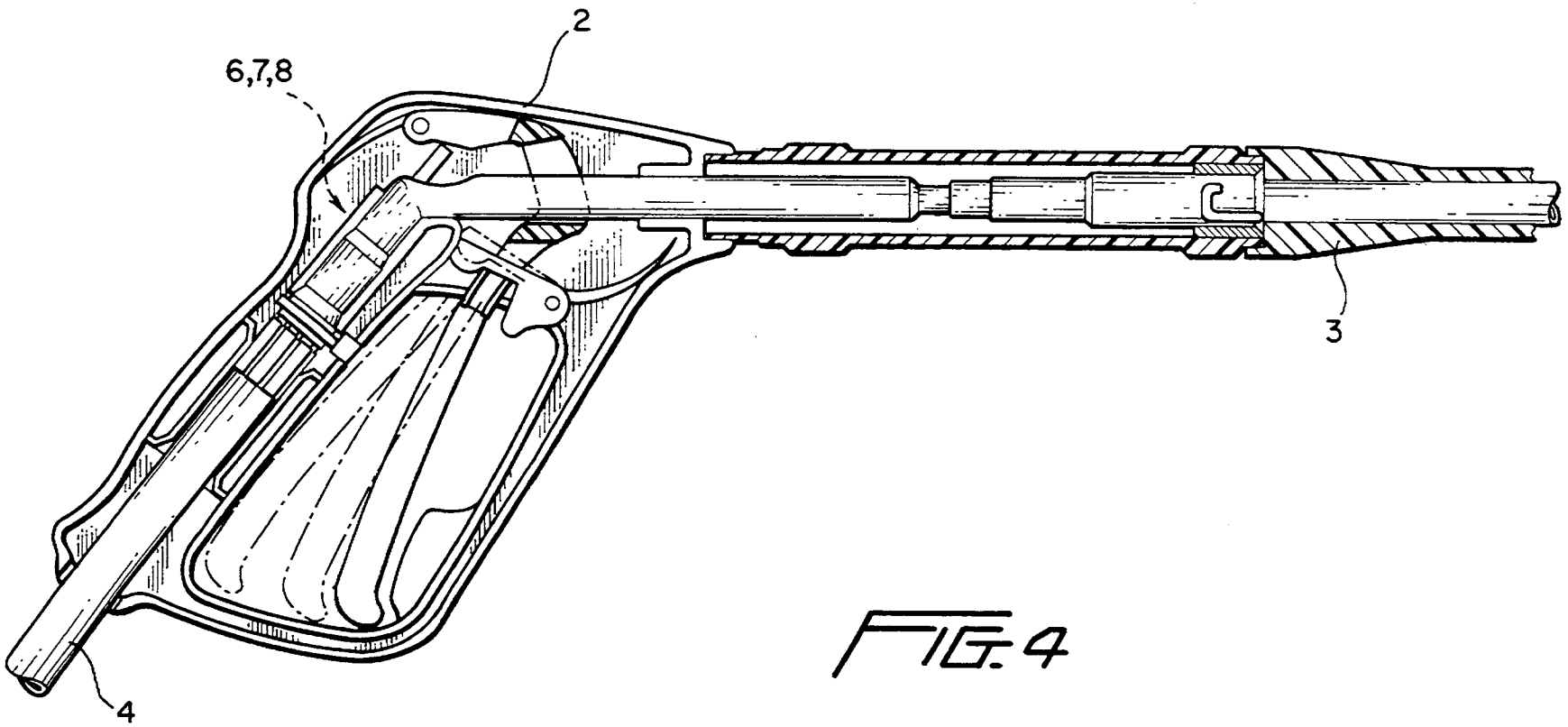
FIG. 4 shows a valve arrangement in a valve pistol according to FIG. 2.

FIG. 4 shows a sectional view of a valve pistol 2 according to FIG. 2, whereas FIG. 1*a* shows a modified valve system for such valve pistol 2 in an enlarged sectional view. With regard to FIG. 4 one will imagine the valve system with a valve mounting 6, valve body 7 and valve seat 8 is positioned within the pressure line (pipe), the operating rod (not marked) extending through a hole in the wall of the pressure line.

Figure 1B:
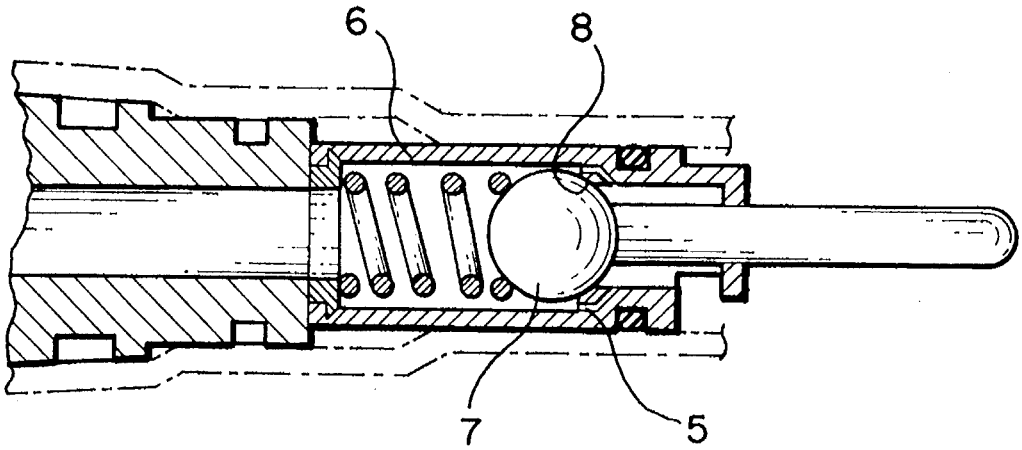
FIG. 1*b* is a second valve arrangement in a valve pistol of a high pressure cleaning device according to the invention.
Figure 5:
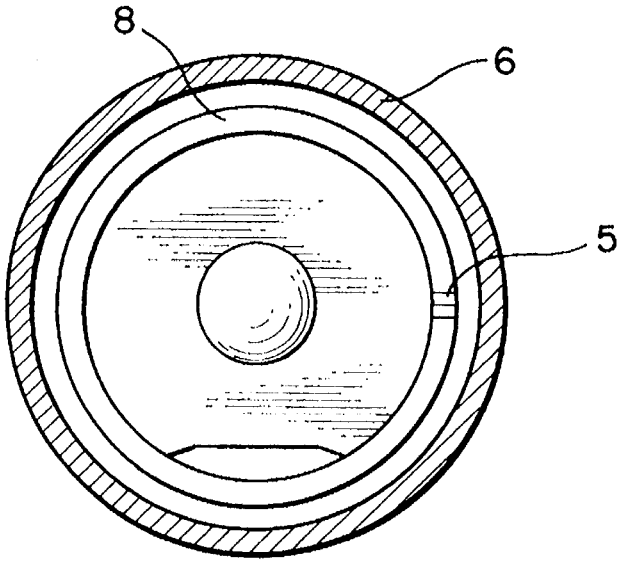
FIG. 5 shows the valve seat according to FIG. 1*a* in a section V—V without the valve body.

FIG. 1 (and partly FIG. 5) show a common flow control valve system for a valve pistol 2 of a high pressure cleaning device of the type in question with a valve mounting 6, a valve body 7, made here as a ball, and a ring-shaped valve seat 8, made here as a force-fit part. Leakage flow passage 5 could be made as a throttled bypass opening running next to the valve body 7 and valve seat 8 as shown in FIG. 1*b*. Then, because of the high flow resistance when valve pistol 2 is open, the bypass throttled opening would have no effect. The embodiment represented in FIG. 1*a* is distinguished especially by the fact that the leakage flow passage 5 is integrated in valve seat 8, in particular, as a notch or radial groove in valve seat 8. The notch running in valve seat 8 in the flow direction, forming leakage flow passage 5, which is not closed by valve body 7, and thus, guarantees the desired leakage flow passing by valve body 7 via valve seat 8, can be seen in FIG. 5.

Figure 1C:
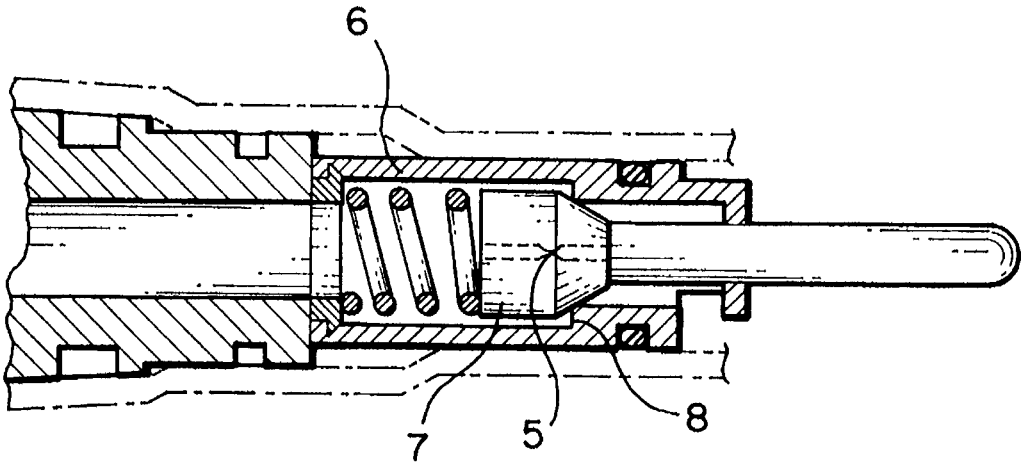
FIG. 1*c* is a third valve arrangement in a valve pistol of a high pressure cleaning device according to the invention.

Alternatively, it is also possible for leakage flow passage 5 to be integrated into valve body 7, in particular, as an axial bore in a valve body 7 that has a constant position as shown in FIG. 1*c*. In a valve body 7 that does not have a constant position, for example, in the valve ball that can be seen in FIG. 1*a*, leakage could also be achieved, for example, through a deliberate unevenness in the surface of the valve ball.

The leakage flow passage 5 is part of the valve pistol 2 in all shown embodiments. It could be part of the circuit at another point, for example on the pump itself, provided that it leads to a suitable leakage.

Especially preferred ranges for the volumes of cleaning fluid applicable for the high pressure cleaning device according to the invention are a leakage flow between about 20 and 500 ccm/min., preferably between 80 and 200 ccm/in., with a normal flow rate of the pump between about 4,000 and about 16,000 ccm/min., preferably between about 7,000 and 9,000 ccm/min, and with a volume of circulating cleaning fluid between 50 and 1000 ccm/min. In the embodiment represented, a high pressure cleaning device can be used that is designed for a rated pressure of 90 bar and a has flow rate of 7,000 ccm/min. With a circulating volume of cleaning fluid of possibly 300 ccm, it is sufficient, according to experiments, to work with a leakage flow of about 100 to 150 ccm/min. Even with a prolonged work pause, the temperature of the cleaning fluid in circulation here does not exceed the value of about 4 C (about 310K). The high pressure cleaning device according to the invention, thus, needs no warning indicator or a shut-off during a prolonged work pause.

The advantage of the high pressure cleaning device according to the invention, compared to the prior art with plugs, obviously, lies in the fact that the high pressure cleaning device is continually able to function and cannot overheat because of its design. The same advantage is also present compared to a high pressure cleaning device that, as is usual in the art, is provided with a temperature sensor to shut off the driving motor, that is, naturally, also expensive from the point of view of control and switching technology, and thus, not especially economical. Compared to a heat-resistant high pressure cleaning device, the cost factor is also a considerable advantage for the high pressure cleaning device according to the invention, considering the fact that very high quality materials simply cannot be used in an economical way in small high pressure cleaning devices.

Figure 6:
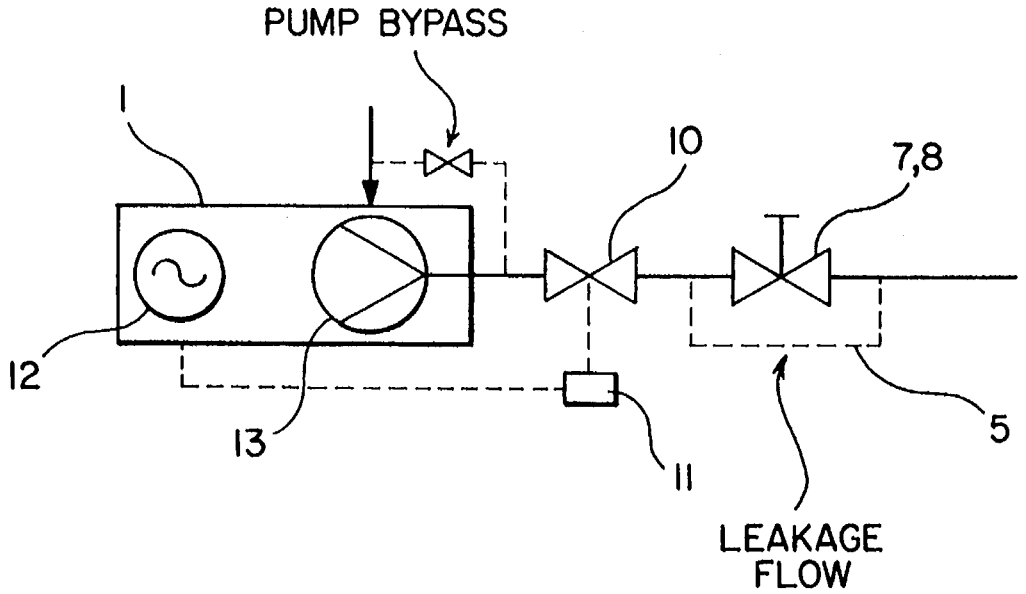
FIG. 6 shows a diagrammatically the layout of a high pressure cleaning device with an additional stop valve.

In the high pressure cleaning device according to the invention, it could be a problem that, when the driving motor, with the pump, is stopped, the valve system 7, 8 of the valve pistol 2 continues to be subject to the water pressure of the water feed line. Since a leakage flow is intended to flow via the valve system 7, 8, the residual pressure of several bar in the water feed line would lead to a constant leakage flow via the valve pistol 2, which would be unnecessary and undesired. To solve this problem, a stop valve 10 whose operation can be controlled by a control unit 11 is used with leakage flow passage 5 to close and stop the leakage flow when the driving motor 12 and the pump 13 are stopped (FIG. 6). The stop valve 10 can be associated with the valve system 7, 8 of the valve pistol 2 as a whole upstream thereof; but, it can also be placed only in the bypass next to the valve system 7, 8 of the valve pistol 2.

Finally, the invention is directed to a valve pistol 2 as such as to be applied with a high pressure cleaning equipment, such valve pistol 2 provided with a leakage flow passage 5 with a very high flow resistance as discribed above.

While a single embodiment in accordance with the present invention has been shown and possible alternatives described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Valve pistol for a high pressure cleaning device of the type having a housing with a driving motor, a pump in the housing for cleaning fluid and a bypass valve arrangement; wherein the valve pistol has a valve means for controlling flow through the valve pistol, said valve means having a valve body and a valve seat; and wherein the valve pistol is provided with a leakage flow passage that has a very high flow resistance and which remains constantly open when the valve means with the valve body and the valve seat is in a closed position, regardless of pressure, said leakage flow passage being free of any manually actuatable closure mechanisms, thereby providing means for a slight leakage flow of cleaning fluid to constantly drain out from the valve pistol via the leakage flow passage, the leakage passage comprising a means for preventing overheating of the pump.

2. Valve pistol for a high pressure cleaning device according to claim 1, wherein the leakage flow passage is integrated into the valve seat as a notch or groove in the valve seat.

3. Valve pistol for a high pressure cleaning device according to claim 1, wherein the leakage flow passage is a throttled bypass opening running next to the valve body and valve seat.

4. Valve pistol for a high pressure cleaning device according to claim 1, wherein the leakage flow passage is integrated into the valve body as an axial bore.

5. In a pressure cleaning device of the type having a housing which is small enough to be transportable, and with a driving motor and a pump in the housing for cleaning fluid and a bypass valve arrangement;

a valve pistol and a high pressure line leading from a high pressure connection on the housing to the valve pistol;

wherein the pump continues to run and circulates a small volume of cleaning fluid via the bypass valve arrangement from a downstream side of the pump to an intake side of the pump when the valve pistol is in a closed position;

wherein, as a means for preventing overheating of the pump, a leakage flow passage is provided that remains open when the valve pistol is in the closed position and has a very high flow resistance, so that, when the valve pistol is closed, a slight leakage flow of cleaning fluid constantly drains out from the valve pistol via the leakage flow passage and is replaced by a corresponding amount of fluid which flows in from the intake side of the pump; and wherein the leakage flow passage is configured to be constantly open, when valve pistol is in the closed position regardless of pressure, and being free of any manually actuatable closure mechanisms.

6. High pressure cleaning device according to claim 5, wherein the valve pistol and the pressure line are integrated in the housing.

7. High pressure cleaning device according to claim 6, wherein the leakage flow passage is located in the valve pistol.

8. High pressure cleaning device according to claim 7, wherein the valve pistol has a flow control valve having a valve body and valve seat; and wherein the leakage flow passage is a throttled bypass opening running next to the valve body and valve seat.

9. High pressure cleaning device according to claim 7, wherein the valve pistol has a flow control valve having a valve body and valve seat; and wherein the leakage flow passage is integrated into the valve seat as a notch or groove in the valve seat.

10. High pressure cleaning device according to claim 7, wherein the valve pistol has a flow control valve having a valve body and valve seat; and wherein the leakage flow passage is integrated into the valve body as an axial bore.

11. High pressure cleaning device according to claim 5, wherein the leakage flow passage is located in the valve pistol.

12. High pressure cleaning device according to claim 11, wherein the valve pistol has a flow control valve having a valve body and valve seat; and wherein the leakage flow passage is a throttled bypass opening running next to the valve body and valve seat.

13. High pressure cleaning device according to claim 11, wherein the valve pistol has a flow control valve having a valve body and valve seat; and wherein the leakage flow passage is integrated into the valve seat as a notch or groove in the valve seat.

14. High pressure cleaning device according to claim 11, wherein the valve pistol has a flow control valve having a valve body and valve seat; and wherein the leakage flow passage is integrated into the valve body as an axial bore.

15. High pressure cleaning device according to claim 5, wherein a stop valve whose operation can be controlled is associated with the leakage flow passage, said stop valve being closable as a means for stopping the leakage flow when the driving motor and pump are stopped.

16. High pressure cleaning device according to claim 6, wherein a stop valve whose operation can be controlled is associated with the leakage flow passage, said stop valve being closable as a means for stopping the leakage flow when the driving motor and pump are stopped.

17. High pressure cleaning device according to claim 5, wherein the leakage flow passage has a size which produces a leakage flow of between about 20 and 500 ccm/min. with a normal pump flow rate of between about 4,000 and about 16,000 ccm/min., and with a volume of circulating cleaning fluid between 50 and 1000 ccm/min.

18. High pressure cleaning device according to claim 6, wherein the leakage flow passage has a size which produces a leakage flow of between about 20 and 500 ccm/min. with a normal pump flow rate of between about 4,000 and about 16,000 ccm/min., and with a volume of circulating cleaning fluid between 50 and 1000 ccm/min.

19. High pressure cleaning device according to claim 17, wherein the leakage flow passage has a size which produces a leakage flow of between 80 and 200 ccm/in. with a normal pump flow rate of between about between 7,000 and 9,000 ccm/min, and with a volume of circulating cleaning fluid between 50 and 1000 ccm/min.

20. High pressure cleaning device according to claim 18, wherein the leakage flow passage has a size which produces a leakage flow of between 80 and 200 ccm/in. with a normal pump flow rate of between about between 7,000 and 9,000 ccm/min, and with a volume of circulating cleaning fluid between 50 and 1000 ccm/min.

* * * * *